United States Patent [19]

Clay

[11] 4,393,908

[45] Jul. 19, 1983

[54] HAMMER WITH TWO DETACHABLE HEADS

[76] Inventor: Howard W. Clay, c/o Endall Company, 5083 27th Ave., Rockford, Ill. 61109

[21] Appl. No.: 258,591

[22] Filed: Apr. 29, 1981

[51] Int. Cl.[3] ..... B25D 1/02

[52] U.S. Cl. ..... 145/29 A

[58] Field of Search ..... 145/29 R, 29 A, 29 B, 145/29 C, 61 J, 61 C, 61 M, 61 K, 61 R, 36; 76/101 D, 114; 173/126, 131, 132

[56] References Cited

U.S. PATENT DOCUMENTS

| | | | |
|---|---|---|---|
| 156,014 | 10/1874 | Coburn | 145/36 |
| 2,692,626 | 10/1954 | Martin | 145/61 J |
| 2,989,101 | 6/1961 | Carmien | 145/29 A |
| 3,088,506 | 5/1963 | Bianchini | 145/36 |
| 3,130,762 | 4/1964 | Kerr | 145/36 |
| 3,618,678 | 11/1971 | Smith | 145/29 A |
| 3,821,973 | 7/1974 | Carmien | 145/29 A |

FOREIGN PATENT DOCUMENTS

| | | | |
|---|---|---|---|
| 937788 | 3/1948 | France | 145/29 R |
| 262359 | 9/1949 | Switzerland | 145/61 |
| 290678 | 5/1953 | Switzerland | 145/29 R |

*Primary Examiner*—Harold D. Whitehead
*Assistant Examiner*—Robert A. Rose
*Attorney, Agent, or Firm*—Leydig, Voit, Osann, Mayer & Holt, Ltd.

[57] ABSTRACT

The heads of the hammer are molded or cast from soft material and are threaded onto opposite ends of a stud extending through a disc on the handle of the hammer. A sleeve nut is welded to a hard metal plate which is captivated within each head and which prevents the sleeve nut from working loose when the hammer is used. The plate is formed with wrenching flats to enable the head to be tightened on the stud. The disc is formed by using a portion of the handle as a die in a die casting machine and is rigidly supported by an integral rod which extends into the handle.

12 Claims, 8 Drawing Figures

HAMMER WITH TWO DETACHABLE HEADS

BACKGROUND OF THE INVENTION

This invention relates generally to a hammer and relates more specifically to a mallet-type hammer having a handle and having two detachable heads made of castable or moldable material such as lead, babbit, brass, plastic or rubber.

In a typical hammer with two heads, a threaded stud extends transversely through a mounting disc or the like on one end portion of the handle. The heads are screwed onto opposite end portions of the stud and are tightened against opposite sides of the disc by turning the heads with a wrench or the like. Internally threaded inserts are usually cast or molded in the heads to receive the stud.

Because the heads are made of relatively soft and flowable material, difficulty is encountered in keeping the heads secured tightly to the handle when the hammer is used repeatedly to strike heavy blows. The soft material tends to flow away from and release the threaded inserts and thus the inserts work loose and tend to turn within the heads. Further difficulty is encountered in providing long-lasting wrenching surfaces on the heads and in keeping the mounting disc tight on the handle.

SUMMARY OF THE INVENTION

The general aim of the present invention is to provide a new and improved hammer of the foregoing type having a handle of greater durability and having heads which can be securely wrenched to tight positions and which will remain tight during service use.

A further object of the invention is to provide a unique hammer head having hard, cast-in-place plate which serves to hold a threaded insert tightly in the head and which, at the same time, provides a hard and long-lasting wrenching surface on the head.

Another object is to provide a hammer head in which a bearing ring is located on the outer side of the hard metal plate and coacts with the handle to hold the head against movement relative to the handle.

Still another object of the invention is to provide a hammer having a novel sheet metal handle which uniquely serves as a die enabling a mounting disc to be cast on and rigidly supported by the handle.

These and other objects and advantages of the invention will become more apparent from the following detailed description when taken in conjunction with the accompanying drawings.

DETAILED DESCRIPTION OF THE PREFERRED EMBODIMENT

Figure 1:
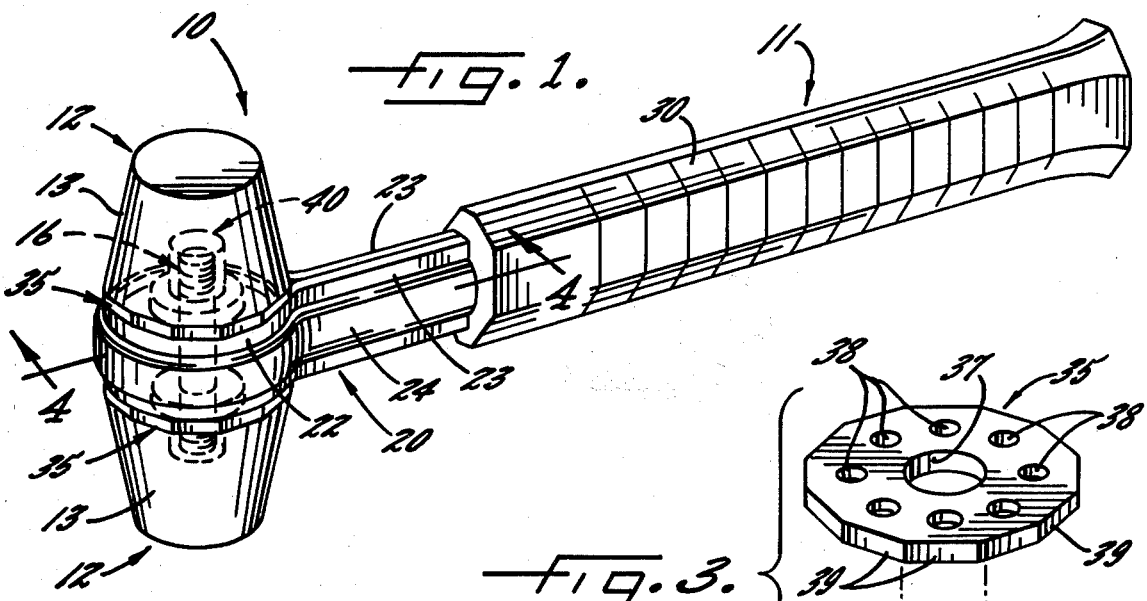
FIG. 1 is a perspective view of a new and improved hammer incorporating the unique features of the present invention.

As shown in the drawings for purposes of illustration, the invention is embodied in a mallet-type hammer 10 having a handle 11 and, in this particular instance, having two detachable heads 12. Each head includes a main body 13 which is generally frustoconical in shape and which may be cast or molded from a comparatively soft material such as lead, babbit, brass, plastic or rubber. Herein, the body of each head is made of lead.

Figure 2:
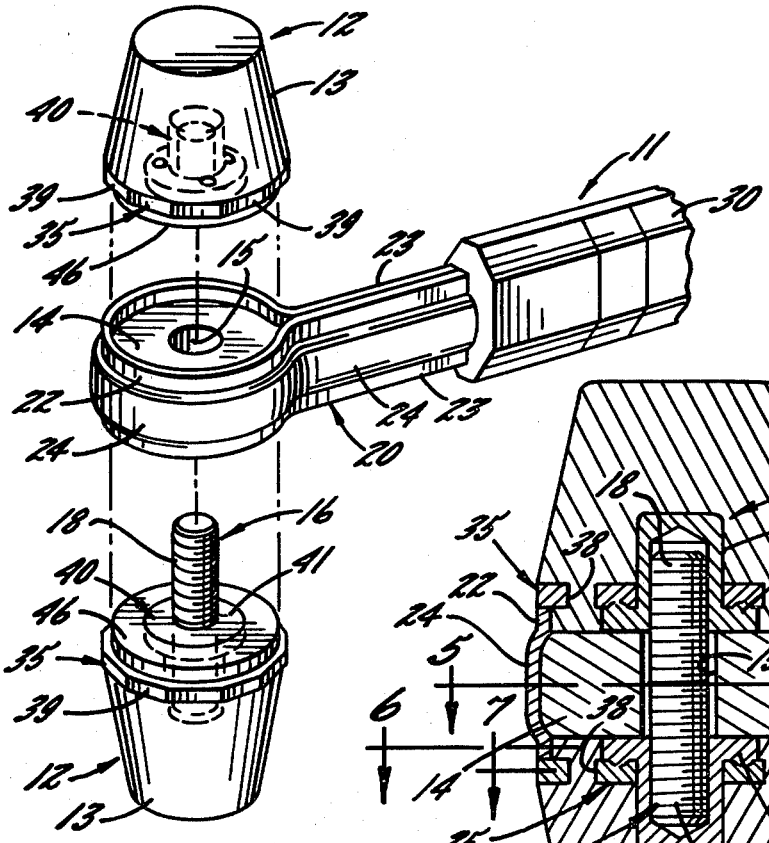
FIG. 2 is an exploded perspective view of the hammer.

One end of the handle 11 includes a relatively thick and heavy disc 14 (FIGS. 2 and 5) which is formed with a central axially extending hole 15. Extending through the hole is a stub 16 (FIG. 4) having treaded end portions 18 projecting in opposite directions from the disc. The heads 12 are adapted to the threaded onto the stud and are adapted to be screwed tightly against the disc.

In accordance with one aspect of the present invention, the handle 11 is uniquely constructed to enable the disc 14 to be formed as a rigid part of the handle. This is achieved by using a portion 20 of the handle as a die when the disc 14 is formed and by forming an integral extension 21 (FIGS. 4 and 5) of the disc within the handle portion 20.

Figure 5:
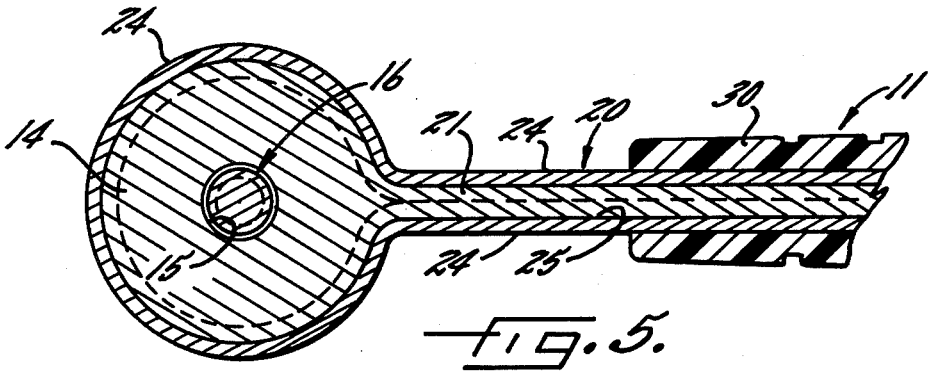
FIGS. 5, 6 and 7 are enlarged fragmentary cross-sections taken substantially along the lines 5—5, 6—6 and 7—7, respectively, of FIG. 1.
Figure 6:
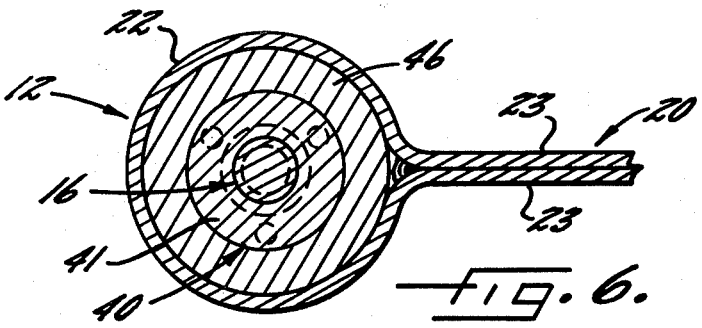

More specifically, the handle portion 20 is made of heavy gage sheet metal and is formed by bending an elongated and initially straight blank of metal in such a manner as to form a cylindrical sleeve 22 (FIG. 6) and two face-to-face elongated strips 23 which extend radially from the sleeve. A raised stiffening rib 24 (FIGS. 1 and 5) extends along the outer sides of the sleeve and the strips and is formed by deforming the sheet metal blank outwardly along its length and midway between its side edges before bending the blank. By virtue of the rib, an elongated cavity 25 (FIG. 5) is defined between the strips and thus the interior of the handle portion 20 is hollow. The outer end of the cavity 25 communicates with the interior of the sleeve 22 in the area where the strips 23 radiate from the sleeve.

The confronting side edges of the strips 23 are welded to one another along the length of the strips so as to fasten the strips together and to close off the sides of the cavity 25. The cavity, however, is left open at the free ends of the strips.

In carrying out the invention, the handle portion 20 formed by the sleeve 22 and the strips 23 is placed in an injection die casting machine and, in effect, forms a die element when the disc 14 is cast. Specifically, dies (not shown) forming part of the machine are positioned in opposite sides of the sleeve 22 and are spaced axially from one another by a distance equal to the thickness of the disc 14. Molten metal (e.g., a steel alloy) then is injected into the handle portion 20 at the free ends of the strips 23, flows through the cavity 25 and fills the space within the sleeve 22 and between the dies. When the metal solidifies, the metal within the sleeve 22 forms the disc 14 and is in intimate contact with the inner side of the sleeve. The disc is captivated within the sleeve by virtue of the metal filling the concavity of the rib 24 around the sleeve. In addition, the metal in the cavity 25 is joined integrally with the disc 14 and forms an extension or rod 21 which fills the cavity and extends along substantially the full length thereof. Accordingly, the disc 14 is anchored very securely to the sheet metal sleeve 22 and strips 23 and will not break loose when heavy blows are applied by the hammer heads 12. After the disc 14 has been formed, a plastic or rubber hand grip 30 is molded over a substantial length of the strips 23.

According to another aspect of the invention, each of the heads 12 is constructed in a novel manner to insure that the heads may be threaded tightly on and will remain tightly secured to the stud 16. In the present instance, this is achieved by casting the body 13 of each head around a hard metal plate 35 and by using the plate to help anchor an internally threaded sleeve 36 in the lead body.

Figure 3:
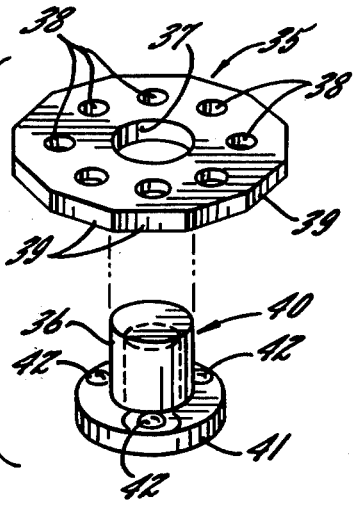
FIG. 3 is an exploded perspective view of the plate and the threaded insert.
Figure 4:
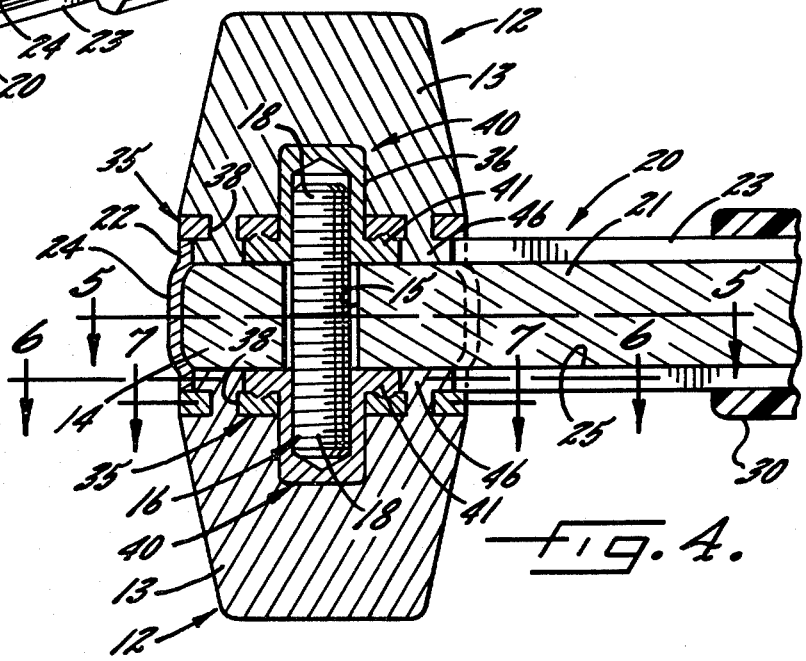
FIG. 4 is an enlarged fragmentary cross-section taken substantially along the line 4—4 of FIG. 1.

As shown in FIG. 4, the plate 35 is located adjacent the larger end of the frustoconical body 13 of each head 12. The plate is made of steel and is formed with a central axially extending hole 37 (FIG. 3) and with several openings 38 which are spaced in a circle around the hole. Several (e.g., twelve) angularly spaced wrenching flats 39 are formed around the periphery of the plate.

The sleeve 36 is internally tapped and forms part of a so-called sleeve nut 40 which also is made of steel. The inner end of the sleeve 36 is closed and the outer diameter of the sleeve is just slightly smaller than the diameter of the hole 37 through the plate 35. A collar or flange 41 which is larger in diameter than the hole 37 is formed integrally with the outer end of the sleeve 36. The diameter of the flange 41, however, is sufficiently small that the flange does not cover the openings 38 when the sleeve 36 is placed in the hole 37. Three angularly spaced protrusions 42 (FIG. 3) are formed integrally with and project inwardly from the inner side of the flange 41 and define weld dimples by which the flange is welded to the outer side of the plate 35 in face-to-face relation therewith. Accordingly, each sleeve nut 40 is secured rigidly to its respective plate 35 with the flange 41 engaging the plate and with the sleeve 36 disposed within the hole 37.

Figure 8:
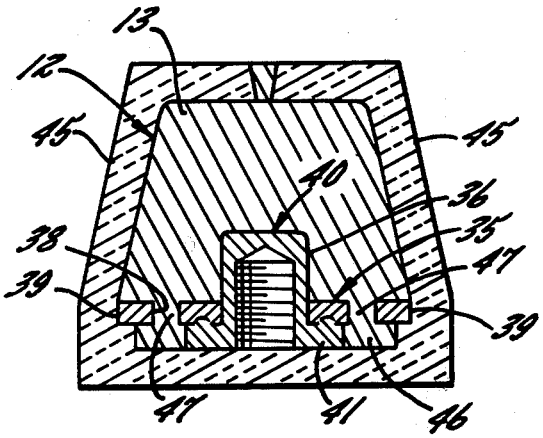
FIG. 8 is a cross-sectional view showing one of the hammer heads disposed within the molds for the head.

To form each head 12, the assembly consisting of the plate 35 and the sleeve nut 40 is captivated within a pair of separable molds 45. As shown in FIG. 8, the molds include mold surfaces which engage the outer side of the flange 41, the wrenching flats 39 and a narrow ring on the outer side of the plate 35 and extending radially inwardly from the periphery of the plate to a circle spaced radially outwardly of the openings 38.

Molten lead then is poured into the molds 45 and fills the molds to form the body 13. Lead also flows through the openings 38 in the plate 35 and is formed by the molds into a ring 46 (FIGS. 2, 6 and 8) whose inner edge intimately encircles the flange 41 and whose outer edge is spaced radially inwardly from the periphery 39 of the plate.

Figure 7:
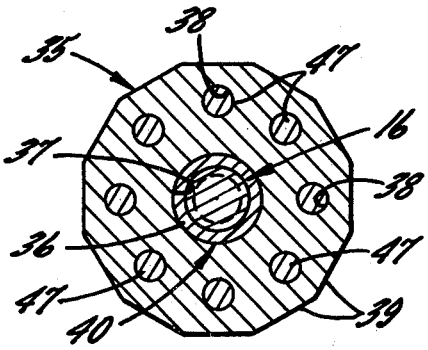

In the finished head 12, the steel plate 35 is captivated axially on the body 13 by the ring 46 and is held against turning by the pieces 47 (FIG. 7) of lead extending through the openings 38 and integrally joined to the ring and the body. Being welded to the plate 35, the sleeve nut 40 is rigidly anchored within the body 13. Accordingly, the sleeve nut 40 is held much more rigidly than would be the case if the nut were simply embedded in soft lead and thus the nut does not turn or work loose when heavy blows are applied by the head 12.

The hammer 10 is assembled by threading the heads 12 onto the stub 16. The outer diameter of the rings 46 is just slightly smaller than the inner diameter of the sleeve 22 and thus the rings telescope snugly into the sleeve as the heads are tightened. The outer peripheries of the rings 46 engage the inner periphery of the sleeve 22 and form bearing surfaces which hold the heads against radial movement relative to the sleeve.

Final tightening of the heads 12 is effected by placing wrenches on the wrenching flats 39 and by turning the heads until the ends of the bearing rings 46 are drawn into tight engagement with the disc 14. Because the wrenching flats are on the hard metal plates 35, there is no danger of wiping the flats away with the wrenches.

From the foregoing, it will be apparent that the present invention brings to the art a new and improved hammer 10 in which both the handle 11 and the heads 12 are constructed in a more durable manner than prior hammers of the same general type. Accordingly, the hammer is capable of experiencing a long service life even when subjected to extremely heavy duty use.

I claim:

1. A hammer head having a main body made of material capable of being cast or molded, a plate made of a substance which is harder than the material of said body, said plate being located adjacent one end of said body, means defining an axially extending and threaded hole in the center of said plate, a collar rigid with the outer face of said plate and encircling the outer portion of said hole, said collar having peripheral margins located radially inwardly of the peripheral margins of said plate, a series of axially extending openings formed through said plate between the peripheral margins of said collar and the peripheral margins of said plate, a ring of said material located on the outer face of said plate and intimately encircling said collar, and pieces of said material integrally joined to said ring and to said body and extending through said openings.

2. A hammer head having a main body made of material capable of being cast or molded, a plate made of a substance which is harder than the material of said body, said plate being located adjacent one end of said body and being formed with a central axially extending hole, an internally threaded sleeve disposed within said body and having an outer portion located within said hole, said sleeve being joined rigidly to said plate and being made of a substance which is harder than the material of said body, a flange integral with the outer portion of said sleeve and located adjacent the outer face of said plate, the peripheral margins of said flange being located radially inwardly of the peripheral margins of said plate, a series of axially extending openings formed through said plate between the peripheral margins of said flange and the peripheral margins of said plate, a ring of said material located on the other face of said plate and intimately encircling said flange, and pieces of said material integrally joined to said ring and to said body and extending through said openings.

3. A hammer head as defined in claim 2 in which wrenching flats are formed around the peripheral margins of said plate.

4. A hammer having a handle and two detachable heads, each of said heads comprising:

a main body made of a material capable of being cast or molded, a plate made of a material which is harder than the material of said body, said plate being located adjacent one end of said body and being formed with a central axially extending hole, wrenching flats formed around the peripheral margins of said plate and unshielded by the material of said body, an internally threaded sleeve disposed within said body and having an outer portion located within said hole, said sleeve being joined rigidly to said plate and being made of a substance which is harder than the material of said body, a flange integral with the outer portion of said sleeve and located adjacent the outer face of said plate, the peripheral margins of said flange being located radially inwardly of the peripheral margins of said plate, a series of axially extending openings formed through said plate between the peripheral margins of said flange and the peripheral margins of said plate, a ring of said material located on the outer face of said plate and intimately encircling said flange, and pieces of said material integrally joined to said ring and to said body and extending through said openings, said handle comprising an elongated handle portion and further comprising a disc on one end of said handle portion, said disc being formed with an axially extending hole, a stud located with the hole in said disc and having threaded end portions extending in opposite directions from said disc and threaded into said sleeves to attach said heads to said handle.

5. A hammer as defined in claim 4 further including a sleeve encircling said disc and attached to said handle, the diameter of each of said rings being just slightly less than the diameter of the sleeve on said handle whereby said rings seat snugly within the latter sleeve.

6. A hammer as defined in claim 4 in which said handle portion is hollow, a handle sleeve on said one end of said handle portion and having an interior communicating with the interior of said handle portion, said disc being made of moldable or castable material and being disposed within the handle sleeve in intimate contact with the inside wall thereof, and a rod integrally joined with said disc and extending into the interior of said handle portion.

7. A hammer as defined in claim 6 in which the diameter of each of said rings is just slightly less than the diameter of said handle sleeve whereby said rings seat snugly within the latter sleeve.

8. A hammer as defined in claim 6 in which said rod extends substantially the full length of the interior of said handle portion.

9. A hammer as defined in claim 6 in which said handle sleeve is integral with said handle portion.

10. A hammer as defined in claim 9 in which said handle sleeve and said handle portion are made of sheet metal.

11. A hammer as defined in claim 10 in which said handle portion is defined by two side-by-side strips of sheet metal.

12. A hammer as defined in claim 11 in which adjacent edges of said strips are welded to one another.

* * * * *